US009257255B2

(12) United States Patent
Dittrich et al.

(10) Patent No.: US 9,257,255 B2
(45) Date of Patent: Feb. 9, 2016

(54) SINGLE-POLE X-RAY EMITTER

(71) Applicants: Ronald Dittrich, Forchheim (DE); Jörg Freudenberger, Kalchreuth (DE); Jan Matschulla, Oderwitz (DE); Ernst Neumeier, Aurachtal (DE); Peter Röhrer, Erlangen (DE)

(72) Inventors: Ronald Dittrich, Forchheim (DE); Jörg Freudenberger, Kalchreuth (DE); Jan Matschulla, Oderwitz (DE); Ernst Neumeier, Aurachtal (DE); Peter Röhrer, Erlangen (DE)

(73) Assignee: Siemens Aktiengesellschaft, München (DE)

( * ) Notice: Subject to any disclaimer, the term of this patent is extended or adjusted under 35 U.S.C. 154(b) by 169 days.

(21) Appl. No.: 14/176,144

(22) Filed: Feb. 9, 2014

(65) Prior Publication Data

US 2015/0043718 A1 Feb. 12, 2015

(30) Foreign Application Priority Data

Aug. 8, 2013 (DE) ..... 10 2013 215 673

(51) Int. Cl.
*H01J 35/10* (2006.01)

(52) U.S. Cl.
CPC ..... *H01J 35/105* (2013.01); *H01J 35/101* (2013.01); *H01J 35/106* (2013.01); *H01J 2235/1006* (2013.01); *H01J 2235/1283* (2013.01)

(58) Field of Classification Search
CPC ..... H01J 2235/1006; H01J 2235/1283; H01J 35/101; H01J 35/105; H01J 35/106
See application file for complete search history.

(56) References Cited

U.S. PATENT DOCUMENTS

| | | | | |
|---|---|---|---|---|
| 5,978,447 | A * | 11/1999 | Carlson | H01J 35/101 378/127 |
| 6,735,283 | B2 | 5/2004 | Kutschera et al. | |
| 2005/0157845 | A1 | 7/2005 | Apel et al. | |
| 2005/0226385 | A1 * | 10/2005 | Simpson et al. | H01J 35/101 378/132 |
| 2008/0056450 | A1 * | 3/2008 | Joshi | H01J 35/101 378/132 |

(Continued)

FOREIGN PATENT DOCUMENTS

| | | |
|---|---|---|
| DE | 102005013718 | 10/2005 |
| DE | 10353964 | 10/2013 |

(Continued)

OTHER PUBLICATIONS

German Office Action dated Mar. 6, 2014 in corresponding German Patent Application No. DE 10 2013 215 673.1 with English translation.

(Continued)

*Primary Examiner* — David J Makiya
*Assistant Examiner* — John Corbett
(74) *Attorney, Agent, or Firm* — Lempia Summerfield Katz LLC

(57) ABSTRACT

A single-pole x-ray emitter includes an emitter housing, in which an x-ray tube with a vacuum housing and a drive motor are arranged. A cathode that generates an electron beam, and a rotating anode that is struck by the electron beam along a focal path are arranged in the vacuum housing. The vacuum housing includes a drive-side housing wall and an anode-side housing wall, and the rotating anode is held in a torsionally rigid manner on an anode tube that is rotatably mounted on a stationary part of a rotor shaft that is coupled to the drive motor. The stationary part of the rotor shaft is joined to the anode-side housing wall of the vacuum housing via a ring-shaped fixing. The anode tube incorporates a temperature compensation element. The focal path is arranged on a side of the rotating anode that faces away from the anode-side housing wall.

6 Claims, 2 Drawing Sheets

(56) References Cited

U.S. PATENT DOCUMENTS

| | | | | |
|---|---|---|---|---|
| 2010/0284519 | A1 | 11/2010 | Moore et al. | |
| 2012/0106713 | A1 | 5/2012 | Parker et al. | |
| 2012/0114104 | A1 | 5/2012 | Treseder et al. | |
| 2013/0177130 | A1 * | 7/2013 | Konno | A61B 6/032 378/4 |
| 2014/0105365 | A1 * | 4/2014 | Legall | H01J 35/101 378/125 |

FOREIGN PATENT DOCUMENTS

| | | | | |
|---|---|---|---|---|
| DE | 102012211281 | | 12/2013 | |
| EP | 0491471 | A2 * | 6/1992 | H01J 35/04 |
| WO | 2010150796 | | 12/2010 | |
| WO | 2012047667 | | 4/2012 | |

OTHER PUBLICATIONS

Willi A. Kalender et al., "High-Resolution Spiral CT of the Breast at Very Low Dose: Concept and Feasibility Considerations", Eur Radiol, Jun. 9, 2011, pp. 1-8, vol. 22.

* cited by examiner

SINGLE-POLE X-RAY EMITTER

This application claims the benefit of DE 10 2013 215 673.1, filed on Aug. 8, 2013, which is hereby incorporated by reference in its entirety.

BACKGROUND

The present embodiments relate to a single-pole x-ray emitter.

An x-ray emitter is known, for example, from US 2012/0114104 A1. The known x-ray emitter includes an emitter housing in which an x-ray tube with a vacuum housing and a drive motor are arranged. A cathode that generates an electron beam, and a rotating anode that the electron beam strikes along a focal path are arranged in the vacuum housing. The vacuum housing has a housing wall on the drive side and a housing wall on the anode side. The rotating anode is held in a torsionally rigid manner on an anode tube that is rotatably mounted on a stationary part of a rotor shaft that is coupled to the drive motor.

In the known situation, the bearing, the rotor shaft and the rotating anode are arranged radially one above the other, and are not geometrically separated from each other. The rotor shaft is embodied in the form of a hollow cylinder, and encloses a stationary part of an axle. The cathode controller (e.g., high voltage and current) is arranged parallel to the axle. In this case, the rotating anode is relatively far away from the anode-side housing wall of the vacuum housing, so that the x-ray tube, and hence the x-ray emitter, have a correspondingly large installation space.

SUMMARY AND DESCRIPTION

The scope of the present invention is defined solely by the appended claims and is not affected to any degree by the statements within this summary.

The present embodiments may obviate one or more of the drawbacks or limitations in the related art. For example, a compact x-ray emitter with improved imaging characteristics is provided.

The single-pole x-ray emitter includes an emitter housing in which an x-ray tube with a vacuum housing and a drive motor are arranged. A cathode that generates an electron beam, and a rotating anode that is struck by the electron beam along a focal path are arranged in the vacuum housing. The vacuum housing includes a housing wall on the drive side and a housing wall on the anode side, and the rotating anode is held in a torsionally rigid manner on an anode tube that is rotatably mounted on a stationary part of a rotor shaft that is coupled to the drive motor. In accordance with one or more of the present embodiments, the stationary part of the rotor shaft is joined to the anode-side housing wall of the vacuum housing by a ring-shaped fixing. The anode tube includes a temperature compensation element, and a bearing of a rotating part of the rotor shaft is arranged within the anode tube. The vacuum housing is arranged so that the vacuum housing is electrically insulated from the emitter housing, and the focal path is arranged on the side of the rotating anode that faces away from the anode-side housing wall of the vacuum housing.

One embodiment of the x-ray emitter is a single-pole x-ray emitter (e.g., the vacuum housing of the x-ray tube and the anode are at the same potential). In contrast, in the case of a double-pole configuration, the vacuum housing of the x-ray tube is insulated relative to the anode and the cathode (e.g., the anode is at a higher potential than the vacuum housing, which is at close to ground potential).

As a result of the fact that the stationary part of the rotor shaft is joined to the anode-side housing wall of the vacuum housing via a ring-shaped fixing, the rotating anode, which is held in a torsionally rigid manner on a rotatably mounted anode tube, may be arranged close to the vacuum housing. This provides that there is a smaller gap between the region in which the focal spot resides, which maps a focal path on the rotating anode, and the outer side of the vacuum housing. In addition to this, the ring-shaped fixing of the stationary part of the rotor shaft to the anode-side housing wall of the vacuum housing provides the potential bonding between the rotating anode and the vacuum housing, which is provided for single-polarity.

As a result of the fact that the anode tube may incorporate a temperature compensation element, and the rotor shaft is joined to the anode-side housing wall, longitudinal expansions of the rotor shaft due to thermal conditions are compensated by the temperature compensation element of the anode tube. This provides that when in operation, the rotating anode has an almost constant axial position and thus an almost constant distance from the cathode. The unavoidable thermal drift of the electron beam is correspondingly greatly reduced, so that an almost constant position is provided for the focal spot. Because the focal spot is almost constant, consistently high quality x-ray recordings are obtained throughout the entire operational time of the x-ray emitter.

The insulating coolant medium (e.g., insulating oil) that is circulating in the emitter housing provides the electrically insulated arrangement of the vacuum housing relative to the emitter housing.

Due to the compact construction, the x-ray emitter is optimally suited to a breast CT system. A breast CT system of this type is, for example, described in the publication "High-resolution spiral CT of the breast at very low dose: concept and feasibility considerations" [W. Kalendar et al., Eur Radiol (2012) 22, pages 1 to 8].

As a result of the fact that a cooling structure is arranged on an outer side of the anode-side housing wall, the distance between the anode-side housing wall of the vacuum housing and the adjacent wall of the emitter housing may be reduced, which results in a further reduction in the installation size of the x-ray emitter.

In one embodiment of the x-ray emitter, the cathode has a first axis that defines a direction of emission of the electrons, and a second axis that defines a high voltage lead. The first axis and the second axis are arranged at right angles to each other. A compact cathode module that requires correspondingly little construction volume, so that the installation size of the x-ray emitter may be further reduced is thus provided.

In one embodiment of the x-ray emitter, the cathode has a first axis that defines a direction of emission of the electrons, and a second axis that defines the high voltage lead. The first axis and the second axis are arranged skew relative to each other. The two axes thus do not intersect, and are also not parallel to each other. The minimum distance between the two axes is greater than the sum of the radii of the anode tube and the focusing head. These measures produce a yet further reduced installation size for the x-ray emitter.

One or more of the present embodiments are suitable for every type of single-pole x-ray emitter. In one embodiment of an x-ray emitter, the drive motor is arranged in the emitter housing and has a high voltage generator unit arranged outside the emitter housing. The drive motor together with a high voltage generator unit may be arranged in the emitter housing (e.g., single tank).

DETAILED DESCRIPTION

Figure 1:
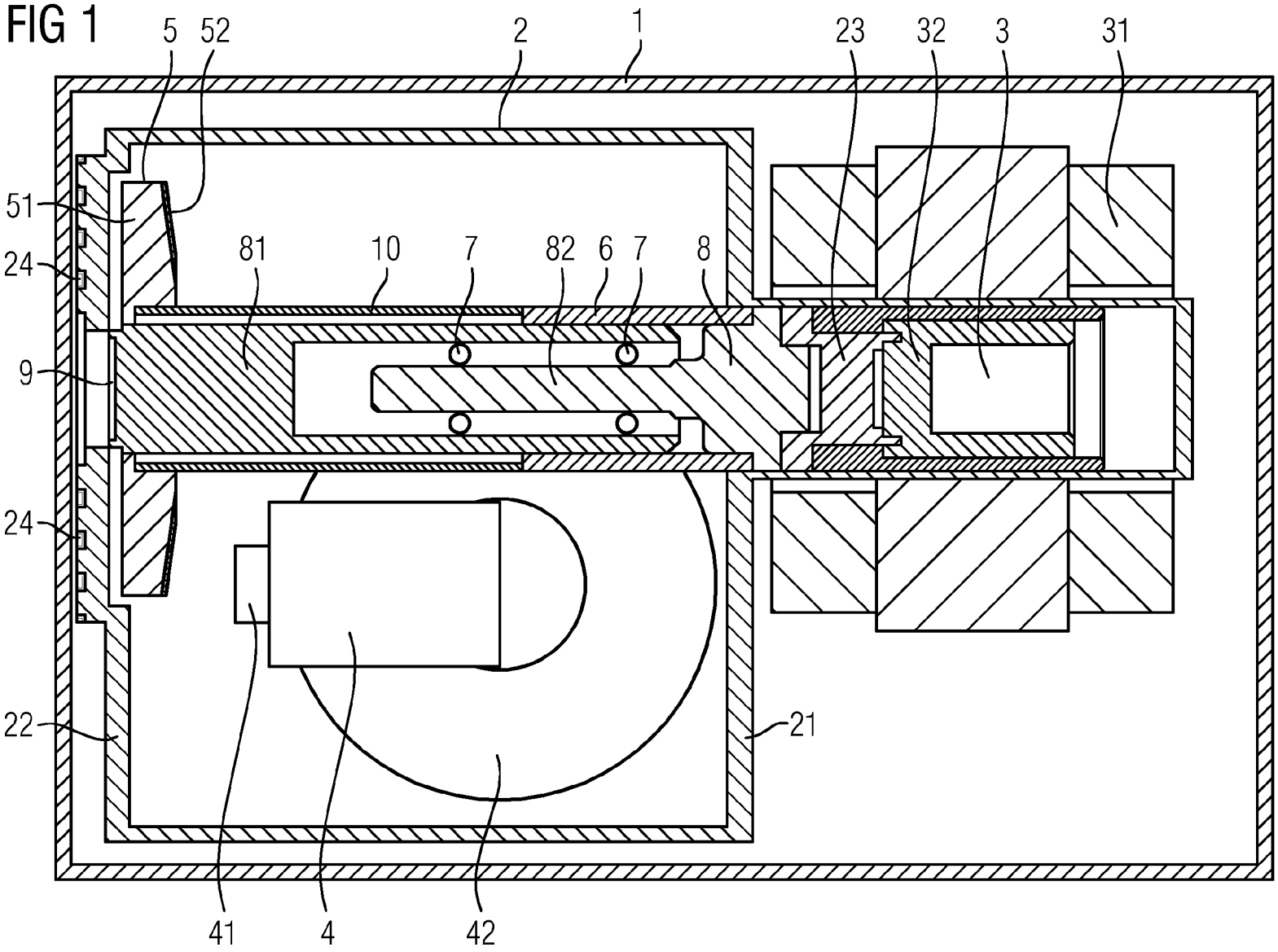
FIG. 1 shows a longitudinal section through one embodiment of a single-pole x-ray emitter.

FIG. 1 shows one embodiment of a single-pole x-ray emitter that incorporates an emitter housing 1. Arranged in the emitter housing 1 is an x-ray tube with a vacuum housing 2 and a drive motor 3.

The vacuum housing 2 includes a housing wall 21 on a drive side, and a housing wall 22 on an anode side. In accordance with one or more of the present embodiments, the vacuum housing 2 is arranged to be electrically insulated from the emitter housing 1.

The drive motor 3 includes a stator 31 that is arranged outside the vacuum housing 2 and within the emitter housing 1, together with a rotor 32 situated within the vacuum housing 2.

Arranged in the vacuum housing 2 is a cathode 4 that includes a focusing head 41 and out of which emerges an electron beam (not shown in FIG. 1).

Figure 2:
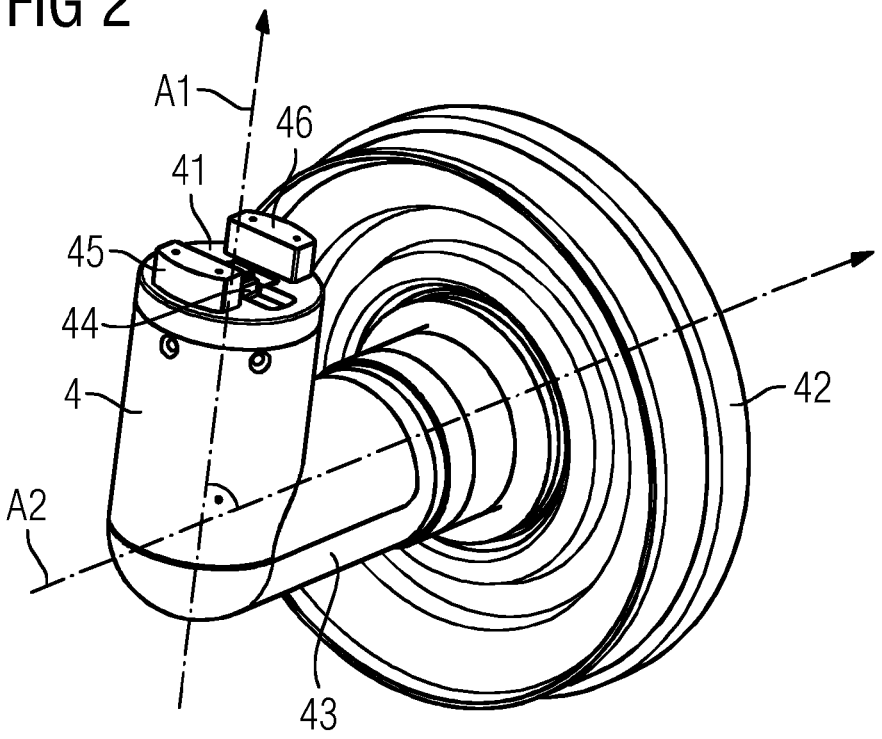
FIG. 2 shows a perspective view of one embodiment of a cathode module with a high voltage insulator.
Figure 3:
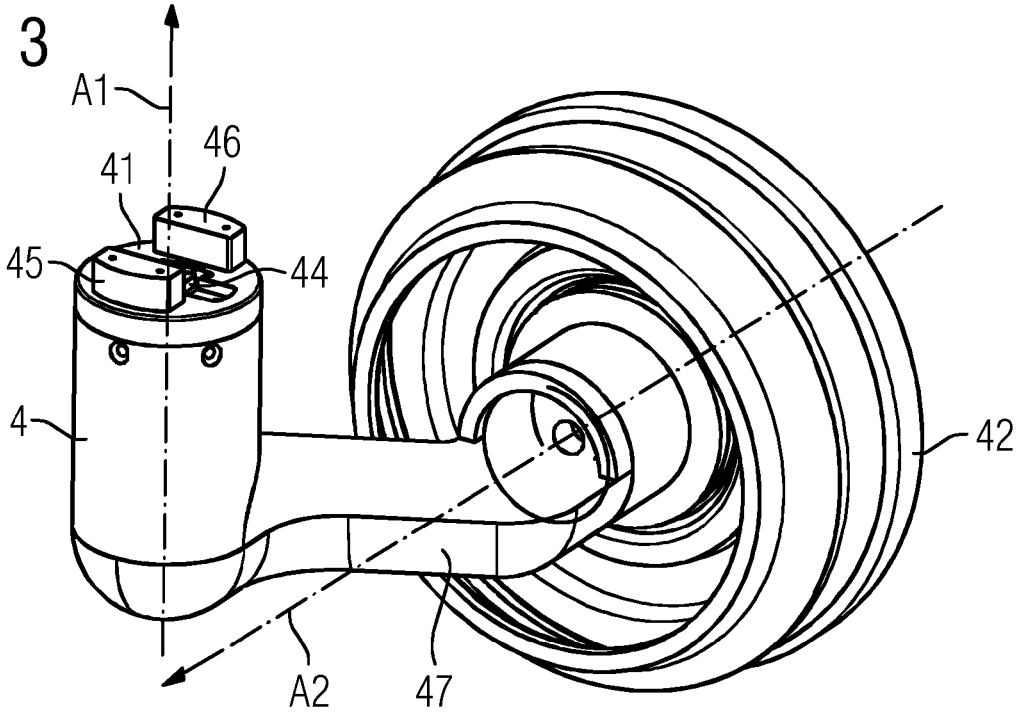
FIG. 3 shows a perspective view of one embodiment of a cathode module with a high voltage insulator.

The cathode 4 is embodied as a cathode module, and is arranged to be isolated from the vacuum housing 2 via a high voltage insulator 42. FIGS. 2 and 3 each show an of a cathode module.

Also arranged in the vacuum housing 2 is a rotating anode 5 that incorporates an anode body 51 together with an anode layer 52 applied to the anode body 51. When the rotating anode 5 is struck by the electron beam, x-rays (not shown in FIG. 1) are produced in the anode layer 52, and the x-rays emerge from the x-ray emitter through an exit window in the vacuum housing 2 and through an exit window in the emitter housing and are available for examination purposes. The exit windows are not shown in FIG. 1.

The electron beam strikes the anode layer 52 at a focal spot, while the region in which the focal spot resides maps a focal path on the anode layer 52 of the rotating anode 5. The focal path is, for example, arranged, in accordance with one or more of the present embodiments, on a side of the rotating anode 5 that faces away from the anode-side housing wall 22 of the vacuum housing 2.

The rotating anode 5 is held in a torsionally rigid manner on an anode tube 6 that is rigidly joined to a rotating part 82 of a rotor shaft 8. The rotating part 82 of a rotor shaft 8 protrudes partially into a stationary part 81 of the rotor shaft 8 and is rotatably mounted on the stationary part 81 via a bearing 7 (e.g., using ball bearings). In this way, the anode tube 6 is arranged so that the anode tube 6 may rotate.

The rotor shaft 8, which is mounted at one end, is coupled to the rotor 32 of the drive motor 3 via a coupling element 23.

In accordance with one or more of the present embodiments, the stationary part 81 of the rotor shaft 8 is joined via a ring-shaped fixing 9 to the anode-side housing wall 22 of the vacuum housing 2. This is realized in the exemplary embodiment shown by a weld.

The anode tube 6 includes a temperature compensation element 10 that, in the embodiment of the single-pole x-ray emitter shown in FIG. 1, is realized by a reduced wall thickness in a radially outer region of the anode tube 6. Within the scope of one or more of the present embodiments, the temperature compensation element 10 may alternatively or additionally also be made of a different material from the anode tube 6.

As a result of the fact that the stationary part 81 of the rotor shaft 8 is joined to the anode-side housing wall 22 of the vacuum housing 2 via a ring-shaped fixing 9, the rotating anode 5, which is held in a rotationally rigid manner on the rotatably mounted anode tube 6, may be arranged close to the vacuum housing 2. There is thus a small distance between the region in which the focal spot resides, which maps a focal path on the rotating anode 5, and the outer side of the vacuum housing 2. The ring-shaped fixing 9 of the stationary part 81 of the rotor shaft 8 on the anode-side housing wall 22 of the vacuum housing 2 provides the potential bonding between the rotating anode 5 and the vacuum housing 2, which is provided for single-polarity.

As a result of the fact that the anode tube 6 incorporates a temperature compensation element 10 and the rotor shaft 8 is joined to the anode-side housing wall 22, longitudinal expansions of the rotor shaft 8 due to thermal conditions are compensated by the temperature compensation element 10 of the anode tube 6. This provides that when in operation, the rotating anode 5 has an almost constant axial position, and thus an almost constant distance from the cathode 4. The unavoidable thermal drift of the point of impact of the electron beam on the anode layer 52 (e.g., region in which the focal spot resides) is correspondingly greatly reduced, so that an almost constant position of the focal spot is provided. Because the focal spot position is almost constant, one obtains consistently high quality x-ray recordings throughout the entire operational time of the x-ray emitter.

There is, in the case of the single-pole x-ray emitter shown in FIG. 1, a cooling structure 24 arranged on an outer side of the anode-side housing wall 22. This provides that a good circulation of the insulating coolant medium (e.g., insulating oil) is provided in spite of the small distance between the anode-side housing wall 22 and the inner side of the emitter housing 1. By this, good electrical insulation of the vacuum housing 2 from the emitter housing 1 is provided.

For the sake of clarity, the lead sheathing of the emitter housing 1 and the power supply for the drive motor 3 and the heating current lead for the cathode 4 are not shown.

FIG. 2 shows one embodiment of a cathode module that incorporates a cathode 4 with a focusing head 41. The focusing head 41 has a circular cylindrical basic shape. Other basic shapes of the focusing head 41 may also be provided.

The focusing head 41 is held via a high voltage lead 43 in a high voltage insulator 42 (see FIG. 1).

Arranged on one face in the focusing head 41 is an emitter 44 that is, for example, in the form of a planar emitter and is at the same potential as the focusing head 41.

On each of the two sides of the emitter 44, the focusing head 41 has a deflecting electrode 45 and 46.

The two deflecting electrodes 45 and 46, with which the electrons emitted from the emitter 44 are deflected and focused, are electrically isolated from the focusing head 41.

The cathode 4 shown in FIG. 2 has a first axis A1 that defines a direction of emission for the electrons emitted by the emitter 44, and a second axis A2 that defines the high voltage lead 43 for the cathode 4.

As a result of the arrangement of the focusing head 41 and the high voltage lead 43, the first axis A1 and the second axis A2 are arranged at right angles to each other.

FIG. 3 shows one embodiment of a cathode module that incorporates a cathode 4 with a focusing head 41. The focusing head 41 is the same in construction to the focusing head shown in FIG. 2.

The focusing head 41 is held via a high voltage lead 47 in a high voltage insulator 42 (see FIG. 1).

The cathode 4 shown in FIG. 3 also has a first axis A1 that defines a direction of emission for the electrons emitted by the emitter 44, and a second axis A2 that defines the high voltage lead 47 for the cathode 4.

As a result of the arrangement of the focusing head 41 and the high voltage lead 47, the first axis A1 and the second axis A2 are arranged skew (e.g., at an oblique angle) relative to each other. In this case, the minimum distance between the axes A1 and A2 is greater than the sum of the radii of the anode tube 6 and the focusing head 41.

The cathode modules shown in FIG. 2 and FIG. 3 are described in detail in German patent application 102012211281.2. Within the ambit of the invention, other embodiments of the focusing head 41 may be provided. Thus, for example, the emitter 44 may alternatively also be constructed as an incandescent filament.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding or following claim, whether independent or dependent, and that such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A single-pole x-ray emitter comprising:

an emitter housing, in which an x-ray tube with a vacuum housing and a drive motor are arranged;

a cathode operable to generate an electron beam, the cathode being arranged in the vacuum housing; and a rotating anode that is struck by the electron beam along a focal path, the rotating anode being arranged in the vacuum housing, wherein the vacuum housing comprises a housing wall on a drive side and a housing wall on an anode side, and the rotating anode is held in a torsionally rigid manner on an anode tube that is rotatably mounted on a stationary part of a rotor shaft coupled to the drive motor, wherein the stationary part of the rotor shaft is joined to the anode side housing wall of the vacuum housing by a ring-shaped fixing, wherein the anode tube incorporates a temperature compensation element, wherein a bearing of a rotating part of the rotor shaft is arranged within the anode tube, wherein the vacuum housing is arranged so that the vacuum housing is electrically insulated from the emitter housing, and wherein the focal path is arranged on a side of the rotating anode that faces away from the anode side housing wall of the vacuum housing.

2. The single-pole x-ray emitter of claim 1, further comprising a cooling structure that is arranged on an outer side of the anode side housing wall.

3. The single-pole x-ray emitter of claim 1, wherein the cathode has a first axis that defines a direction for emission of electrons, and a second axis that defines a high voltage lead, and wherein the first axis and the second axis are arranged at right angles to each other.

4. The single-pole x-ray emitter of claim 1, wherein the cathode has a first axis that defines a direction for emission of the electrons, and a second axis that defines a high voltage lead, and wherein the first axis and the second axis are arranged skew relative to each other.

5. The single-pole x-ray emitter of claim 1, wherein the drive motor is arranged in the emitter housing and comprises a high voltage production unit arranged outside the emitter housing.

6. The single-pole x-ray emitter of claim 1, wherein the drive motor is arranged together with a high voltage production unit in the emitter housing.

* * * * *